US007585828B2

(12) United States Patent
Gallagher et al.

(10) Patent No.: US 7,585,828 B2
(45) Date of Patent: Sep. 8, 2009

(54) WINDSHIELD WASHER FLUID COMPOSITION, ADDITIVE CONCENTRATE FOR USE THEREIN, AND METHODS OF USING THE SAME

(75) Inventors: Laurie A. Gallagher, New Milford, CT (US); Andrew E. Fenwick, Danbury, CT (US)

(73) Assignee: Honeywell International Inc., Morristown, NJ (US)

( * ) Notice: Subject to any disclaimer, the term of this patent is extended or adjusted under 35 U.S.C. 154(b) by 464 days.

(21) Appl. No.: 11/376,742

(22) Filed: Mar. 15, 2006

(65) Prior Publication Data

US 2006/0247143 A1 Nov. 2, 2006

Related U.S. Application Data

(60) Provisional application No. 60/662,179, filed on Mar. 15, 2005.

(51) Int. Cl.
*C11D 3/20* (2006.01)
*B08B 3/08* (2006.01)

(52) U.S. Cl. ..... 510/182; 510/180; 510/181; 134/34; 134/37; 134/40; 134/42

(58) Field of Classification Search ..... 510/180, 510/181, 182; 134/34, 37, 40, 42
See application file for complete search history.

(56) References Cited

U.S. PATENT DOCUMENTS

| | | | | |
|---|---|---|---|---|
| 5,164,522 | A | 11/1992 | McCarthy et al. | |
| 5,378,787 | A | 1/1995 | Vrckovnik et al. | |
| 6,169,066 | B1 | 1/2001 | Gasmena | |
| 6,461,537 | B1 | 10/2002 | Turcotte et al. | |
| 7,378,382 | B2 * | 5/2008 | Serobian et al. | 510/466 |
| 7,393,401 | B2 * | 7/2008 | Hasinovic et al. | 106/271 |
| 7,481,948 | B2 * | 1/2009 | Jeffcoate et al. | 252/71 |
| 2001/0028892 | A1 | 10/2001 | Policello | |
| 2001/0029238 | A1 | 10/2001 | Policello | |
| 2002/0120057 | A1 | 8/2002 | Gosselink et al. | |
| 2003/0198847 | A1 * | 10/2003 | Jeffcoate et al. | 429/26 |
| 2004/0138400 | A1 | 7/2004 | Lange et al. | |

FOREIGN PATENT DOCUMENTS

| | | | |
|---|---|---|---|
| EP | 0699435 | A2 | 6/1996 |
| WO | WO 2006007926 | A1 | 1/2006 |

OTHER PUBLICATIONS

International Search Report dated Jul. 19, 2006 for PCT/US2006/009346, International Filing Date Mar. 15, 2006.
Written Opinion of the International Searching Authority dated Jul. 19, 2006 for PCT/US2006/009346, International Filing Date Mar. 15, 2006.

* cited by examiner

*Primary Examiner*—Douglas Mc Ginty
(74) *Attorney, Agent, or Firm*—Cantor Colburn LLP.

(57) ABSTRACT

Disclosed are windshield washer compositions comprising a nonionic amino-modified silicone-polyalkyl copolymer, said copolymer being water dispersible and hydrophilic. In one embodiment, the disclosed washer compositions are ready to use washer fluids. In another embodiment, the disclosed windshield washer compositions are additive concentrates. Also disclosed is a method of treating a glass surface comprising applying the disclosed compositions to a glass surface. In one embodiment, a suitable glass surface is the windshield of a transportation vehicle such as an automobile.

14 Claims, No Drawings

WINDSHIELD WASHER FLUID COMPOSITION, ADDITIVE CONCENTRATE FOR USE THEREIN, AND METHODS OF USING THE SAME

CROSS REFERENCE TO RELATED APPLICATIONS

The application claims the benefit of U. S. Provisional application, Ser. No. 60/662,179, filed Mar. 15, 2005, the contents of which are incorporated herein by reference thereto in their entirety.

FIELD OF THE INVENTION

The present invention relates generally to washer fluid compositions for use with vehicle windshields, more particularly to washer fluids that function as an aid in both deicing and in repelling water, water-borne dirt, and/or dirt from windshields.

BACKGROUND OF THE INVENTION

Motor vehicles such as cars and trucks have typically been equipped with windshield washers and wipers. The washers operate by pumping or squirting a small jet of an aqueous fluid over the area of the windshield normally contacted by the windshield wipers. The windshield wipers then wipe the fluid across the windshield to clean off grime, ice, rain, salt, snow, slush, and the like. The term 'grime' as used herein refers collectively to any materials that impair a driver's windshield visibility. Illustrative examples of grime include dirt, dust, sand, ash, leaves, residue from chemical deicers, salt, bug juice, mud, bird droppings, and the like.

However, in addition to removing grime, consumers have also valued traditional windshield washer compositions for facilitating deicing, i.e., the removal of ice from windshields. Windshield washer/deicer fluids may contain water, a water miscible alcohol to depress the freezing point, and a colorant. Some washer/deicer fluids will contain a surfactant for lubricating. Many deicer or anti-icing compositions rely upon an alcohol, in particular methanol, to impart the ice-melting properties to traditional windshield washer compositions.

However, consumers have also expressed a desire for windshield washer compositions that aid in repelling water and grime from a windshield. Such compositions would be advantageous in that they would act to reduce applications of washer solution by the driver.

Illustrative compositions said to impart water-repelling properties to windshields include those comprising alkyl-substituted disilicanes and alkoxy-substituted di-and tri-silicanes. In other prior art, mono-alkoxy silicanes have been described as useful as a bonding composition for use with water-repellent compositions comprising a hydrocarbon wax and a polyamide. No water-repellency is attributed to the silanes themselves.

Much of the prior art teaches the inclusion of hydrophobic siloxanes. For example, U.S. Pat. No. 5,973,055 discloses a water repellant composition that comprises a hydrophobic organopolysiloxane or silicone liquid. U.S. Pat. No. 6,461,537 discloses a windshield washer composition that includes quaternary compounds, especially siloxane based quaternary compounds that are dispersible in water, alcohol, and mixtures thereof, wherein the quaternary compounds impart a good degree of hydrophobicity to the windshield surface.

Unfortunately, the inclusion of such hydrophobic compounds either substantially reduces or eliminates the ability of the windshield washer composition to facilitate deicing.

There thus remains a need for improved windshield washer compositions; particularly those that facilitate both ice removal and water and grime repellant properties.

SUMMARY OF THE INVENTION

Disclosed are windshield washer compositions comprising a nonionic amino-modified silicone-polyalkyl copolymer, said copolymer being water dispersible and hydrophilic.

In one embodiment, the disclosed washer compositions are ready to use washer fluids. In one exemplary embodiment, such ready to use washer fluids comprise 20 to 40% by weight of a monoalcohol, 0.001 to 2.0% by weight of optional additives selected from dyes, defoamers, and combinations thereof, 0.05 to 1.0% by weight of the nonionic amino-modified silicone-polyalkyl copolymer, and 80 to 60% by weight of water, based on the total amount of the composition.

In another embodiment, the disclosed windshield washer compositions are additive concentrates that comprise 10 to 99.99% by weight of a monoalcohol, 0.01 to 5.00% by weight of the nonionic amino-modified silicone-polyalkyl copolymer, and 90 to 0% by weight of water, based on the total amount of the composition.

Also disclosed is a method of treating a glass surface by applying the disclosed washer composition to a windshield.

Finally a method of treating a glass surface is disclosed that comprises applying a composition to a glass surface, wherein the composition comprises a nonionic amino-modified silicone-polyalkyl copolymer, said copolymer being water dispersible and hydrophilic. In one exemplary embodiment, the composition is applied to the windshield of a transportation vehicle via the windshield reservoir and wiper systems of the transportation vehicle.

DETAILED DESCRIPTION OF THE EMBODIMENTS

The disclosed windshield washer compositions comprise a silicone copolymer that is water dispersible and hydrophilic. While not wishing to be bound to a particular theory, it is believed that the disclosed compositions form a temporary water-soluble film that temporarily increases the hydrophobicity of the windshield to a degree sufficient to increase water and grime repellancy.

The term "hydrophilic" as used herein relates to the ability of the copolymer to improve the wettability of fabric. It has unexpectedly been found that copolymers possessing such an optimum level of hydrophilicity in regards to fabric provide a minimum degree of hydrophobicity in regards to water and grime repellency for a windshield while retaining the ability to melt ice and snow from a windshield.

An illustrative example of suitable silicone copolymer is one that comprises both reactive or functional groups such as amino groups, and nonionic groups such as polyalkylene oxide groups.

In one embodiment, the term "reactive groups" or "functional groups" as used herein refers to those groups which form hydrogen bonds with silanol functionality present in a glass surface such as an automotive windshield or the like.

In one exemplary embodiment, the nonionic groups will be present in an amount necessary to provide the necessary degree of hydrophilicity. Thus, in one exemplary embodiment, the term "polyalkyl copolymer" as used herein refers to polymers containing repeating ether groups, i.e., [—C—O—C—].

It has been found that a particularly suitable silicone copolymer having the requisite degree of hydrophilicity is one that when applied to a 100% thermal bonded polyester in an amount of 1%, changes the wettability of the fabric to less than 1 sec as compared to a water control that has a wettability of more than 300 sec, wherein wettability is evaluated per AATCC 79-1986.

In one embodiment, suitable silicone copolymers are amino modified silicone polyether copolymers. In one exemplary embodiment, the silicone copolymer will be a nonionic amino modified silicone polyether copolymer.

Illustrative examples of suitable amino modified silicone polyether copolymers are believed to be disclosed in U.S. Pat. Nos. 6,593,274 and 6,673,359, hereby incorporated by reference.

For example, in one embodiment, suitable aminomodified silicone polyethers may be described as amino siloxane alkoxylates of the general formula: $ZMe_2SiO[(Me)_2SiO]_x SiMe_2Q$, wherein x=0 to 2; $Q=C_aH_{2a}O(C_2H_4O)_b(C_3H_6O)_cR$; a=2 to 4; b=1 to 12; c=0 to 5, providing that when c is >0, (b+c)=2 to 12; R is hydrogen, acetyl or a hydrocarbon radical between 1 and 4 carbon atoms; Z is $BN[DO(C_dH_{2d}O)_cR]_{2-z} V_z$ wherein each d is 2 to 4, each e is 0 to 15, z=0 to 2, each V is a univalent group, D is an alkylene divalent bridging group on which there may be hydroxyl substituents, and B is a divalent bridging group.

In one embodiment, V groups may be alkyl groups (which may be branched, linear or cyclic) of less than 8 carbons, which may or may not contain hydroxyl functionalities. In another exemplary embodiment, V may be an alkyl amine functionality, the nitrogen of which may be further substituted (e.g. with an alkyl) or be further alkoxylated. In one especially exemplary embodiment, V may be one of ethyl, 2-hydroxyethyl, 3-hydroxypropyl, methyl, or 2-aminoethyl.

In one embodiment, B groups may be of the formula D(O) y(CdH2dO)jD wherein D and d are as above, j=0 to 8, preferably 0 to 2, and y=0 or 1. In one exemparly embodiment D may have 2 to 6 carbon atoms and B may also be a divalent alkylene group of $C_2$-$C_4$.

When Q or B is a mixture of oxyalkylenes, it may be blocked or random. One skilled in the art will understand the advantages in the position of the oxyethylene relative to the oxypropylene, when the alkyleneoxide group is blocked.

The Z groups may include protonated amines, i.e, where there is a hydrogen ion attached to the nitrogen in the Z group, which can occur to the amino siloxane alkoxylates under acidic conditions. Also suitable are quaternary versions of Z, i.e., where there is a third $R_3$ group on the nitrogen in Z.

Suitable amino modified silicone-polyether copolymers may be made by the hydrosilation of a terminal hydridosiloxane with allyl glycidal ether, and allyl started polyalkyleneoxide. This may be followed by ring opening of the epoxide moiety with a primary or secondary amine. Such components are commercially available. Alternatively, the hydrosilation may take place with an allyl amine and an allyl started polyalkyleneoxide. Hydrosilation reaction conditions may be found in Marcienic, ed., 122-23 and 558-568 (1995), which is incorporated herein. Amine intermediate (e.g., allyl amine) may be prepared by reaction of an unsaturated halide (e.g., allyl bromide) and an amine. The allyl amine also may be prepared by reaction of an allyl glycidyl ether (or similar unsaturated epoxide) with an amine (which result in an ether bond in the bridging group B). An alternative method uses aziridine, which is not preferred for toxicity reasons, are disclosed in PCT US97/04128, which is incorporated herein by reference.

An exemplary embodiment of a suitable commercially available amino modified silicone-polyether copolymer is Formasil™ 593, commercially available from GE Silicones of Friendly, W.Va., as a mixture of more than 80% of a aminomodified silicone-polyether copolymer and less than 20% of a polyalkylene oxide. It will be appreciated that Formasil™ is herein used as a commercially available example of a nonionic amino-modified silicone-polyalkyl copolymer suitable for use in the disclosed compositions and methods.

In one embodiment, the silicone copolymer may generally be used in amounts of from 0.01 to 5.00% by weight of the nonionic amino-modified silicone-polyalkyl copolymer.

In another embodiment, when the disclosed compositions are employed as windshield washing compositions, the silicone copolymer may be used in amounts of from 0.05 to 1.0% by weight, based on the total weight of the composition. In one exemplary embodiment, when the disclosed compositions are employed as windshield washing compositions, the silicone copolymer may be used in amounts of from 0.1 to 0.5% by weight, based on the total weight of the composition.

When the disclosed compositions are employed as additive concentrates that are added to traditional windshield washer compositions, the silicone copolymer may be used in amounts of from 0.05 to 1.0% by weight of the nonionic amino-modified silicone-polyalkyl copolymer, based on each 16 fl. oz of the concentrate. In another embodiment of the additive concentrate, the silicone copolymer may be used in amounts of from 1.00 to 2.0% by weight of the nonionic amino-modified silicone-polyalkyl copolymer, based on each 16 fl. oz of the concentrate.

The windshield washer compositions may also optionally comprises an optional polyol component such as, for example, a glycol, a fluorinated polyether diol, or a combination comprising one or more of the foregoing compounds. The optional polyol component may be a low viscosity component such as a glycol having a viscosity of less than or equal to about 5000 centipoise.

Suitable glycols include, for example, ethylene glycol, 1,2-propylene glycol, 1,3- propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,6-pentylene glycol, neopentyl glycol, hexane diols, and the like, and combinations comprising one or more of the foregoing glycols.

The optional polyol compound comprises about 0 wt % to about 40 wt % of the total weight of the windshield washer composition. In another embodiment, the auxiliary compound comprises about 1 wt % to about 30 wt % of the total weight of the windshield washer composition. In another embodiment, the auxiliary compound comprises about 1 wt % to about 20 wt % of the total weight of the windshield washer composition. In another embodiment, the auxiliary compound comprises about 1 wt % to about 5 wt % of the total weight of the windshield washer composition. When the auxiliary compound is silicone oil, the silicone oil may, for example, comprise about 1 wt % to about 5 wt % of the total weight of the windshield washer composition. When the auxiliary compound is a glycol, the glycol may, for example, comprise about 1 wt % to about 40 wt % of the total weight of the windshield washer composition.

Suitable monoalcohols for use in both the washer compositions and the additive concentrate include those that are solvents for both the silicone copolymer and the optional polyol compound. Suitable solvents include, for example, water and alcohols such as methanol, ethanol, isopropanol, and combinations thereof.

The disclosed windshield washer compositions may also comprise additional additives such as, for example, dyes and pigments, antifoam agents, buffering agents, and the like.

Suitable buffering agents include, for example, organic and inorganic acids and bases, including salts thereof, such as mono- or poly-alkali metal, alkaline earth metal or amine salts of carbonic acid, phosphoric acid, sulfuric acid, hydrosulfaric acid, a $C_1$-$C_6$ organo-, mono- or poly-carboxylic acid, or a $C_2$-$C_{30}$ alkyleneiminopolycarboxylic acid, ammonia, a $C_1$-$C_{30}$ organic base, or a combination comprising one or more of the foregoing buffering agents. Exemplary buffering agents include sodium bicarbonate, sodium carbonate, ammonium hydroxide, ammonium carbonate, sodium borate, mono-, di-, or trisodium phosphate, mono-, di-, or tripotassium phosphate, ammonium sodium phosphate, mono-, or disodium sulfate, acetic acid, sodium acetate, potassium acetate, ammonium acetate, calcium acetate, sodium formate, mono-, or disodium sulfide, ammonia, mono-, di, or triethylamine, mono-, di-, or triethanolamine, (ethylenedinitrilo) tetraacetic acid sodium salt (sodium E.D.T.A.), pyridine, aniline, sodium silicate, and combinations comprising one or more of the foregoing buffering agents.

When the disclosed windshield washer compositions are employed as additive concentrates, they may generally comprise from 10 to 99.99% by weight of a monoalcohol, 0.01 to 5.00% by weight of the nonionic amino-modified silicone-polyalkyl copolymer, and 90 to 0% by weight of water, based on each 16 fl oz of the composition.

When the disclosed washer compositions are employed as traditional washer compositions, they may generally comprise from 20 to 40% by weight of a monoalcohol, 0.001 to 2.0% by weight of optional additives selected from dyes, defoamers, and combinations thereof, 0.05 to 1.0% by weight of the nonionic amino-modified silicone-polyalkyl copolymer, and 80 to 60% by weight of water, based on the total amount of the composition.

The windshield washer compositions can be formed, for example, by mixing the components. If desired, the pH of the windshield washer composition may be adjusted with the foregoing buffering agents.

The pH of the windshield washer composition is optionally adjusted. The windshield washer compositions may have a pH of about 4 to about 6, or about 5.

The windshield washer compositions of the invention are also advantageous in that they are characterized by low turbidity or haze. In one exemplary embodiment, the disclosed washer compositions appear to be clear to the average consumer.

Also disclosed is a method of treating a glass surface or windshield or window. In one embodiment, the disclosed method comprises disposing on or applying to a glass surface a washer composition comprising the particular silicone copolymer as described above.

Illustrative examples of suitable glass surfaces include any glass surface subjected to grime. In one exemplary embodiment, a suitable glass surface is any windshield or window subjected to grime. In one especially exemplary embodiment, suitable glass surfaces for use in the disclosed method are the windows and windshields of transportation vehicles such as cars, trucks, boats, planes, trains, and the like.

In one exemplary embodiment, suitable glass surfaces will comprise groups capable of forming hydrogen bonds with the nonionic amino-modified silicone-polyalkyl copolymer present in the applied composition. In one embodiment, suitable glass surfaces will comprise silanol functional groups that form hydrogen bonds with the nonionic amino-modified silicone-polyalkyl copolymer present in the applied composition. In one exemplary embodiment, the nonionic amino-modified silicone-polyalkyl copolymer will comprise one or more reactive groups such as ether groups that form hydrogen bonds with the silanol functionality present in the glass surface.

In one embodiment, the disclosed washer compositions may be disposed on or applied to a suitable glass surface by any of several suitable application methods.

Illustrative examples of suitable application methods include spraying, rolling, wiping, pouring, and combinations thereof.

Illustrative examples of spray applications include application via a trigger sprayer, a pressurized or aerosol sprayer, or the windshield washer reservoir of an automobile, for example. Application via rolling may be accomplished either manually or automatically with the use of a saturated roller such as is used for the application of coatings. Wiping can be accomplished either manually or automatically with simple cloths or papers. An example of a combination application would be with the windshield washer reservoir system of a transportation vehicle in combination with an action of one or more windshield or window wipers of said vehicle.

In one exemplary embodiment of the disclosed method, the disclosed washer compositions will be applied to a window or windshield of a transportation vehicle. In one especially exemplary embodiment of the disclosed method, the transportation vehicle is an automobile.

All ranges disclosed herein are inclusive and combinable. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. "Optional" or "optionally" means that the subsequently described event or circumstance may or may not occur, and that the description includes instances where the event occurs and instances where it does not. The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

EXAMPLES

Illustrative examples of the disclosed compositions were prepared by combining the materials as indicated in Tables 1 and 2 below.

TABLE 1

| Component | Weight % |
|---|---|
| Methanol | 34.75 |
| Chromatech Bright Yellow Dye | 0.005 |
| XD-56 Antifoam Agent | 0.02 |
| Formasil 593 | 0.2 |
| Water | Balance |

TABLE 2

| Component | Weight % |
|---|---|
| Methanol | 55.0 |
| Isopropanol | 14.0 |
| Ethylene glycol | 17.3 |
| Formasil 593 | 1.6 |
| Water | Balance |

The windshield washer composition of Table 1 was found to have deicing capabilities equal to traditional window washing compositions not containing any silicon containing compounds and more than three times the deicing capability of a commercially available water repellant windshield washing composition to which the composition of Table 1 had equivalent repellency properties.

The invention claimed is:

1. The washer composition, comprising 0.01 to 0.5% by weight of the nonionic amino-modified silicone-polyalkyl copolymer, said copolymer being water dispersible and hydrophilic;

10 to 99.99% by weight of a monoalcohol, and 90 to 0% by weight of water, wherein weight percent is based on the total weight of the composition.

2. The washer composition of claim 1 further comprising 0 to 50% by weight of optional polyols, and 0 to 2.0% by weight of optional additives, based on the total weight of the composition.

3. The washer composition of claim 2 comprising 20 to 40% by weight of a monoalcohol, 0.001 to 2.0% by weight of optional additives selected from dyes, defoamers, and combinations thereof, 0.05 to 0.5% by weight of the nonionic amino-modified silicone-polyalkyl copolymer, and 80 to 60% by weight of water, based on the total weight of the composition.

4. A washer composition, comprising 0.01 to 0.5% by weight of the amino-modified silicone-polyalkyl copolymer, said copolymer being water dispersible and hydrophilic, 10 to 99.99% by weight of a monoalcohol, and 90 to 0% by weight of water, wherein weight percent is based on the total weight of the composition

5. The washer composition of claim 4 wherein the amino-modified silicone-polyalkyl copolymer is an amino modified silicone polyether copolymer.

6. The washer composition of claim 4 wherein the amino-modified silicone-polyalkyl copolymer is a nonionic amino modified silicone polyether copolymer.

7. A method of treating a glass surface, comprising applying the washer composition of claim 4 to a glass surface.

8. The method of claim 7 wherein the glass surface is a windshield of a transportation vehicle.

9. The method of claim 7 wherein the nonionic amino-modified silicone-polyalkyl copolymer is a nonionic amino-modified silicone-polyalkyl copolymer that comprises groups that form hydrogen bonds with functional groups in the glass surface.

10. The method of claim 9 wherein the nonionic amino-modified silicone-polyalkyl copolymer comprises reactive groups that form hydrogen bonds with silanol functional groups present in the glass surface.

11. The method of claim 7 wherein the composition comprises 20 to 40% by weight of a monoalcohol, 0.001 to 2.0% by weight of optional additives selected from dyes, defoamers, and combinations thereof, 0.05 to 0.5% by weight of the amino-modified silicone-polyalkyl copolymer, and 80 to 60% by weight of water, based on the total weight of the composition.

12. The method of claim 8 wherein the composition is applied to the windshield via a windshield wiper reservoir system in combination with an action of a windshield wiper.

13. The washer composition of claim 1, comprising 0.05 to 0.5% by weight of the nonionic amino-modified silicone-polyalkyl copolymer, based on the total weight of the composition.

14. The washer composition of claim 4, comprising 0.05 to 0.5% by weight of the amino-modified silicone-polyalkyl copolymer, based on the total weight of the composition.

* * * * *

UNITED STATES PATENT AND TRADEMARK OFFICE

CERTIFICATE OF CORRECTION

PATENT NO. : 7,585,828 B2
APPLICATION NO. : 11/376742
DATED : September 8, 2009
INVENTOR(S) : Gallagher et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 501 days.

Signed and Sealed this

Fourteenth Day of September, 2010

David J. Kappos

David J. Kappos
*Director of the United States Patent and Trademark Office*